US010909947B2

(12) United States Patent
Itahana

(10) Patent No.: US 10,909,947 B2
(45) Date of Patent: Feb. 2, 2021

(54) DISPLAY DEVICE, DISPLAY SYSTEM, AND METHOD OF CONTROLLING DISPLAY DEVICE

(71) Applicant: SEIKO EPSON CORPORATION, Tokyo (JP)

(72) Inventor: Kyosuke Itahana, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/362,870

(22) Filed: Mar. 25, 2019

(65) Prior Publication Data

US 2019/0295499 A1 Sep. 26, 2019

(30) Foreign Application Priority Data

Mar. 26, 2018 (JP) ..... 2018-057639

(51) Int. Cl.
*G09G 5/00* (2006.01)
*G09G 5/36* (2006.01)

(52) U.S. Cl.
CPC ..... *G09G 5/006* (2013.01); *G09G 5/363* (2013.01); *G09G 2354/00* (2013.01); *G09G 2370/12* (2013.01)

(58) Field of Classification Search
CPC .... G09G 5/006; G09G 5/363; G09G 2354/00; G09G 2370/12
See application file for complete search history.

(56) References Cited

U.S. PATENT DOCUMENTS

2009/0187817 A1* 7/2009 Ivashin ..... G06F 17/241 715/230
2011/0001701 A1* 1/2011 Nakano ..... G02B 27/026 345/157
2011/0231791 A1* 9/2011 Itahana ..... G06F 1/1645 715/799
2012/0144283 A1* 6/2012 Hill ..... G06F 17/242 715/211
2013/0093672 A1* 4/2013 Ichieda ..... G03B 21/26 345/157
2013/0106908 A1* 5/2013 Ichieda ..... G09G 3/02 345/629
2013/0314439 A1* 11/2013 Ota ..... G06T 11/60 345/629

(Continued)

FOREIGN PATENT DOCUMENTS

JP 2017-111164 A 6/2017

*Primary Examiner* — Yu Chen
(74) *Attorney, Agent, or Firm* — Oliff PLC

(57) ABSTRACT

A display device includes a generation unit that generates image data according to a position of a pointer, a communication unit that communicates with an information processing device that generates image data according to the position of the pointer, and a control unit that causes the communication unit to perform a transmission operation of transmitting image information corresponding to an image including an image indicated by the image data generated by the generation unit in a first state in which the generation unit generates the image data according to the position of the pointer, to the information processing device, when a state is switched from the first state to a second state in which the information processing device generates the image data according to the position of the pointer.

15 Claims, 7 Drawing Sheets

(56) References Cited

U.S. PATENT DOCUMENTS

| | | | | |
|---|---|---|---|---|
| 2015/0130847 | A1* | 5/2015 | Masuoka | G09G 3/20 345/665 |
| 2015/0227262 | A1* | 8/2015 | Ichieda | G06F 3/0425 345/204 |
| 2016/0252984 | A1* | 9/2016 | Fujimori | G06F 3/04883 345/179 |
| 2016/0260410 | A1* | 9/2016 | Fujimori | G06F 3/0488 |

* cited by examiner

D1

| | No. | OBJECT | GROUP | COLOR | COORDINATE | ROTATION | ··· | ··· | ··· |
|---|---|---|---|---|---|---|---|---|---|
| V1 | G1 | FREE LINE | 1 | BLACK | (X:100. Y:200) | 0 | | | |
| V2 | G2 | FREE LINE | 1 | BLACK | (X:100. Y:200) | 0 | | | |
| V3 | G3 | FREE LINE | 1 | BLACK | (X:100. Y:200) | 0 | | | |
| V4 | G4 | DIAGRAM (TRIANGLE) | 0 | BLUE | (X:100. Y:200) | 45 | | | |
| B1 | G5 | IMAGE | 0 | – | (X:100. Y:200) | – | | | |

D2

| | No. | OBJECT | COLOR | TRANSMISSION | COORDINATE | ROTATION | ... | ... | ... |
|---|---|---|---|---|---|---|---|---|---|
| V11 | G11 | FREE LINE | YELLOW | 50 | (X:100. Y:200) | 0 | | | |
| B11 | G12 | IMAGE | – | 0 | (X:100. Y:200) | 0 | | | |
| V12 | G13 | TEXT | BLACK | 0 | (X:100. Y:200) | 0 | | | |

DISPLAY DEVICE, DISPLAY SYSTEM, AND METHOD OF CONTROLLING DISPLAY DEVICE

CROSS-REFERENCE

The entire disclosure of Japanese Patent Application No. 2018-057639, filed Mar. 26, 2018 is expressly incorporated by reference herein.

BACKGROUND

1. Technical Field

The present invention relates to a display device, a display system, and a method of controlling the display device.

2. Related Art

In JP-A-2017-111164, a system including a display device such as a projector and an information processing device such as a personal computer (PC) is disclosed. In this system, either the display device or the information processing device generates image data according to the position of a pointer.

In the system disclosed in JP-A-2017-111164, if both the display device and the information processing device have the function of generating the image data according to the position of the pointer, it is conceivable that a state shifts from a state in which the display device generates the image data to a state in which the information processing device generates the image data.

Here, in the system disclosed in JP-A-2017-111164, the generation function of the display device and the generation function of the information processing device are independent of each other.

Therefore, when the above-described situation occurs, the information processing device cannot take over the image indicated by the image data generated by the display device.

SUMMARY

An aspect of a display device according to the invention includes a generation unit that generates image data according to a position of a pointer, a communication unit that communicates with an information processing device that generates image data according to the position of the pointer, and a control unit that causes the communication unit to perform a transmission operation of transmitting image information corresponding to an image including an image indicated by the image data generated by the generation unit in a first state in which the generation unit generates the image data according to the position of the pointer, to the information processing device, when a state is switched from the first state to a second state in which the information processing device generates the image data according to the position of the pointer.

According to the aspect, even if a main entity that generates the image data according to the position of the pointer is switched from the display device to the information processing device, the information processing device can take over the image indicated by the image data generated by the display device.

In the aspect of the display device described above, it is preferable that the control unit causes the communication unit to perform a transmission operation after ending the first state and starting the second state, when a switching instruction to switch the first state to the second state is received.

According to the aspect with this configuration, it is possible to use the instruction to switch the first state to the second state as an instruction to take over the image. Therefore, even if there is no instruction to take over the image, it is possible to automatically take over the image indicated by the image data generated by the display device.

In the aspect of the display device described above, it is preferable that the control unit causes the communication unit to perform the transmission operation after ending the first state and starting the second state, when a notification of requesting the second state is received.

According to the aspect with this configuration, it is possible to use the notification of requesting the second state as the instruction to take over the image. Therefore, even if there is no instruction to take over the image, it is possible to automatically take over the image indicated by the image data generated by the display device.

In the aspect of the display device described above, it is preferable that the image information is bitmap format image data.

According to the aspect with this configuration, even if the image including the image indicated by the image data generated by the display device is a complicated image, the information processing device can reproduce the image with high reproducibility.

In the aspect of the display device described above, it is preferable that the image information includes vector data in which the image data generated by the generation unit is represented on an object unit basis.

According to the aspect with this configuration, it is possible to edit the image data taken over by the information processing device on an object unit basis.

In the aspect of the display device described above, it is preferable that the communication unit receives the image information corresponding to the image including the image indicated by the image data generated by the information processing device in the second state, when the state is switched from the second state to the first state.

According to the aspect with this configuration, the information processing device can take over the image according to the image data generated by the display device.

An aspect of a display system according to the invention includes the display device described above and the information processing device.

According to the aspect, even if the main entity that generates image data according to the position of the pointer is switched from the display device to the information processing device, the information processing device can take over the image indicated by the image data generated by the display device.

An aspect of a method of controlling a display device according to the invention includes generating image data according to a position of a pointer, and transmitting image information corresponding to an image including an image indicated by the image data generated in a first state in which the generation unit generates the image data according to the position of the pointer, to the information processing device, when a state is switched from the first state to a second state in which the information processing device generates the image data according to the position of the pointer.

According to the aspect, even if a main entity that generates the image data according to the position of the pointer is switched from the display device to the information processing device, the information processing device can take over the image indicated by the image data generated by the display device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
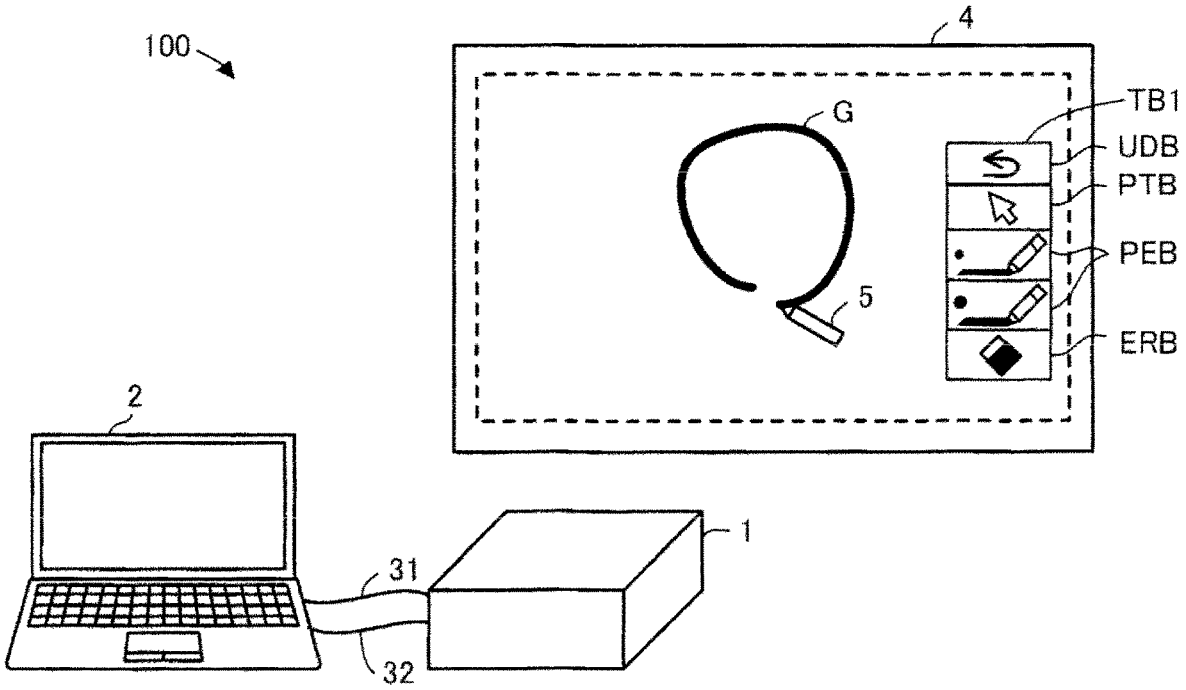
FIG. 1 is a diagram illustrating a display system according to a first embodiment.

Hereinafter, embodiments will be described with reference to the drawings. Dimensions and scale of each part in the drawings are different from actual ones as appropriate. Various technical limitations are given to the embodiments. However, the scope of the invention is not limited to these embodiments.

First Embodiment

FIG. 1 is a diagram illustrating a display system 100 according to a first embodiment.

The display system 100 includes a projector 1 and a personal computer (PC) 2. The projector 1 is an example of a display device. The PC 2 is an example of an information processing device. The projector 1 is connected to the PC 2 by high definition multimedia interface (HDMI) cable 31 and a universal serial bus USB) cable 32.

The PC 2 transmits image data to the projector 1 via the HDMI cable 31. The projector 1 transmits and receives various data items to and from the PC 2 via the USB cable 32. The projector 1 projects and displays an image corresponding to the image data (hereinafter, referred to as "received image data") received from the PC 2 on the screen 4. The screen 4 is an example of a display surface.

The projector 1 captures an image of screen 4 using an image capturing unit 16 which will be described later, and then, generates captured image data. The projector 1 detects a position of a pointer 5 based on the captured image data. The pointer 5 is, for example, an electronic pen that emits infrared light. If the pointer 5 is an electronic pen that emits infrared light, the projector 1 detects the position of the pointer 5 based on a light emitting position of the infrared light represented in the captured image data. Hereinafter, it is assumed that an electronic pen emitting the infrared light is used as the pointer 5.

The projector 1 has an operation mode in which the position of the pointer 5 is used. The projector 1 has a "PJ interactive mode" and a "PC interactive mode".

The PJ interactive mode is an operation mode in which the projector 1 generates the image data according to the position of the pointer 5. Hereinafter, the image data generated according to the position of the pointer 5 in the PJ interactive mode is also referred to as "PJ image data".

The PC interactive mode is an operation mode in which the PC 2 generates the image data according to the position of the pointer 5. Hereinafter, the image data generated according to the position of the pointer 5 in PC interactive mode is also referred to as "PC image data". In the PC interactive mode, the projector 1 transmits position information (hereinafter, also referred to as "position information") indicating the position of the pointer 5 to the PC 2 via the USB cable 32. The state in which the PC 2 generates the image data according to the position of the pointer 5 is an example of a second state.

The projector 1 switches the operation mode between the "PJ interactive mode" and the "PC interactive mode" according to an operation of a remote controller or the like (not illustrated).

FIG. 1 illustrates an example of an image projected on the screen 4 when the operation mode is the PJ interactive mode. In screen 4 illustrated in FIG. 1, an image G indicated by the PJ image data and a first toolbar TB1 usable in the PJ interactive mode are illustrated.

In a situation where the image G and a first toolbar TB1 are displayed on the screen 4, when the operation mode is switched from the PJ interactive mode to the PC interactive mode, the projector 1 transmits the image information corresponding to the image including the image G to the PC 2.

Figure 2:
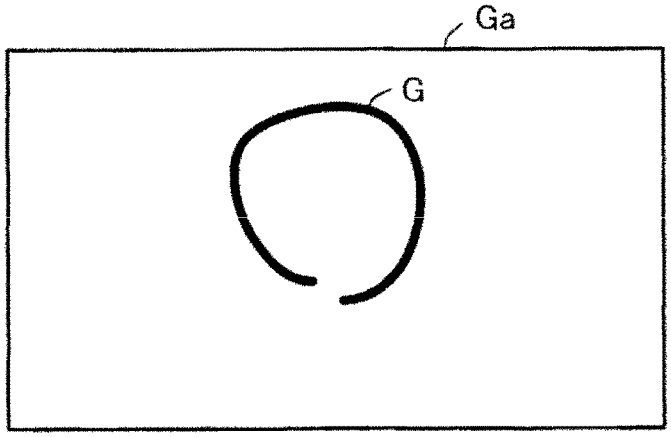
FIG. 2 is a diagram illustrating an example of a transmission image indicated by transmission image information.

Hereinafter, the image information corresponding to the image including the image indicated by the PJ image data is also referred to as "transmission image information". FIG. 2 is a diagram illustrating an example of a transmission image Ga indicated by the transmission image information.

Figure 3:
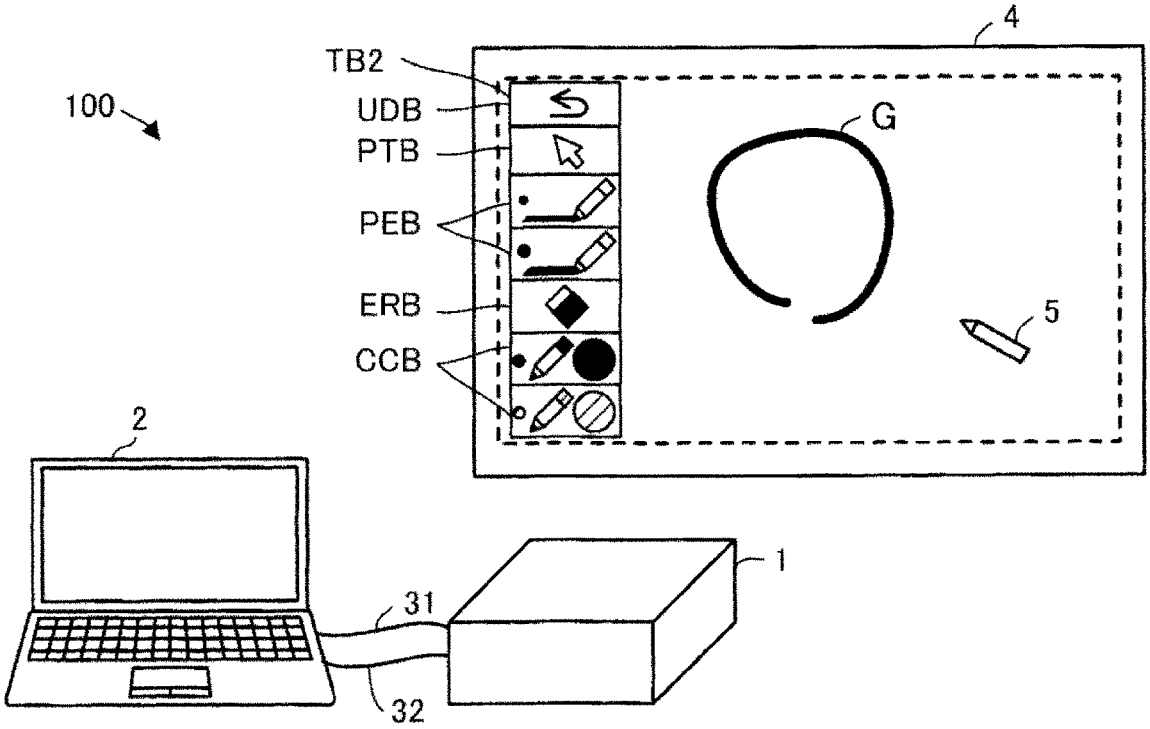
FIG. 3 illustrates an example of an image projected on a screen when an operation mode is switched to a PC interactive mode.

FIG. 3 illustrates an example of an image projected on the screen 4 when the operation mode is switched to the PC interactive mode. In the screen 4 illustrated in FIG. 3, the image G included in the transmission image Ga and a second toolbar TB2 usable in the PC interactive mode are displayed.

As illustrated, when the operation mode is switched from the PJ interactive mode to the PC interactive mode, the projector 1 transmits transmission image information to the PC 2. Therefore, the PC 2 can take over the image G according to the PJ image data generated in the PJ interactive mode. As a result, it is possible to reduce the possibility that the PJ image data is wasted.

Figure 4:
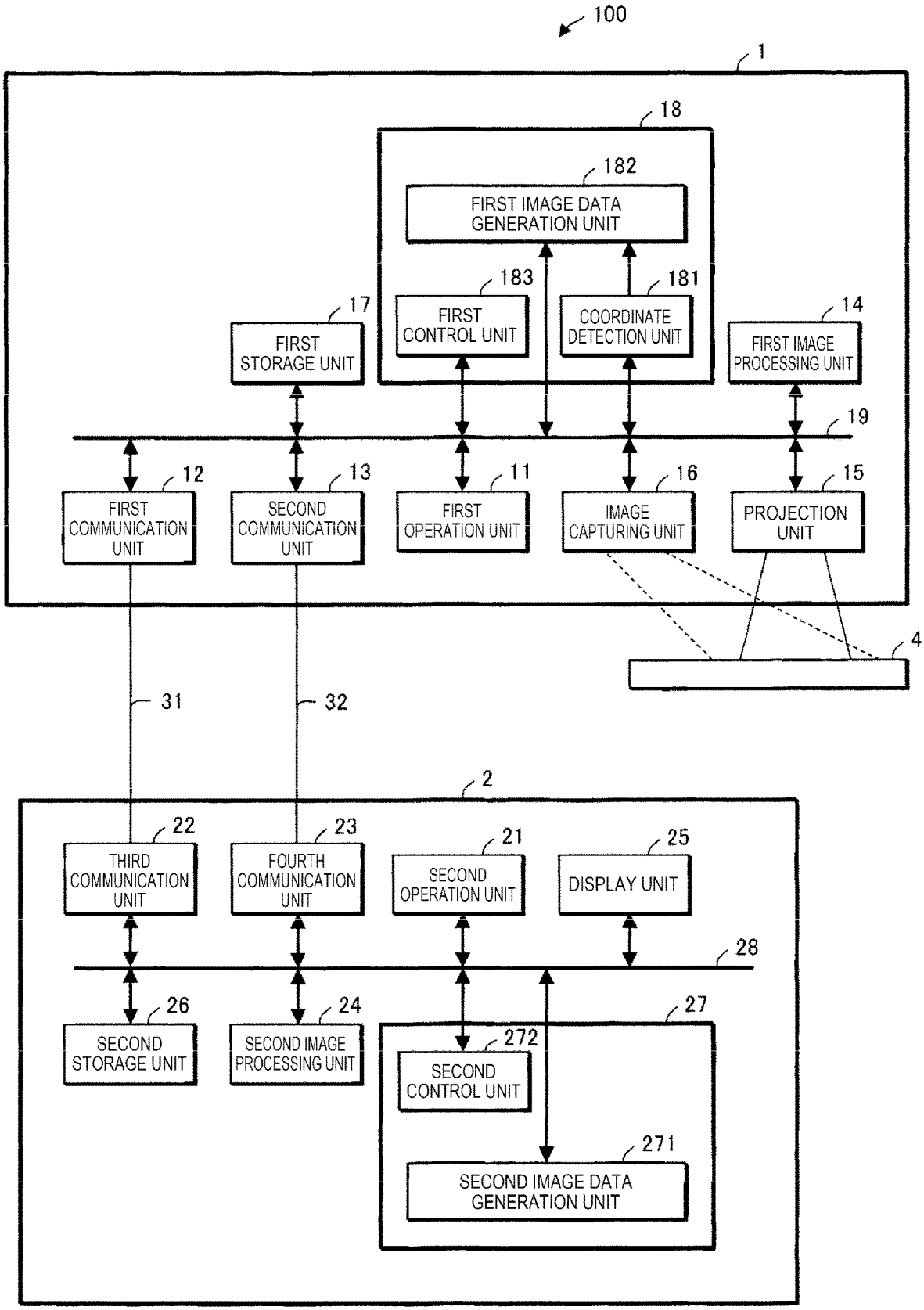
FIG. 4 is a diagram illustrating an example of a projector and a PC.

Next, configurations of the projector 1 and the PC 2 will be described. FIG. 4 is a diagram illustrating an example of the projector 1 and the PC 2.

First, the projector 1 will be described.

The projector 1 includes a first operation unit 11, a first communication unit 12, a second communication unit 13, a first image processing unit 14, a projection unit 15, an image capturing unit 16, a first storage unit 17, a first processing unit 18, and a first bus 19. The first operation unit 11, the first communication unit 12, the second communication unit 13, the first image processing unit 14, the projection unit 15, the image capturing unit 16, the first storage unit 17, and the first processing unit 18 can communicate with each other via the first bus 19.

The first operation unit 11 is, for example, various operation buttons, operation keys or a touch panel. The first operation unit 11 receives an input operation from a user of the display system 100 (hereinafter, simply referred to as a "user"). The first operation unit 11 may be a remote controller or the like which transmits information corresponding to the input operation by the user by a wireless or a wired communication. In that case, the projector 1 includes a receiving unit for receiving the information transmitted from the remote controller. The remote controller includes various operation buttons, operation keys, or touch panel that receive the input operations by the user. The first operation unit 11 receives switching information to switch the operation mode. The switching information is an example of a switching instruction.

The first communication unit 12 communicates with the PC 2 via the HDMI cable 31. The first communication unit 12 receives the image data from the PC 2.

The second communication unit 13 is an example of a communication unit. The second communication unit 13 transmits and receives various data to and from the PC 2 via the USB cable 32. The second communication unit 13 transmits the transmission image information to the PC 2 when the operation mode is switched from the PJ interactive mode to the PC interactive mode. The second communication unit 13 transmits the position information to the PC 2 when the operation mode is the PC interactive mode.

The first image processing unit 14 performs image processing on the image data to generate an image signal.

In the PJ interactive mode, the first image processing unit 14 generates an image signal indicating a superimposed image in which the image G and the first toolbar TB1 are superimposed on the image indicated by the received image data using the received image data, the PJ image data, and first toolbar data indicating the first toolbar TB1.

The first toolbar TB1 illustrated in FIG. 1 includes a cancel button UDB for returning the processing to the initial state, a pointer button PTB for selecting a mouse pointer, a pen button PEB for selecting a pen tool for drawing, an eraser button ERB for selecting the eraser tool that erases the drawn image.

In the PJ interactive mode, the user causes the projector 1 to perform the processing according to the clicked button by selectively clicking these buttons using the pointer 5. For example, the user can draw the image G illustrated in FIG. 1 by selecting the pen tool and moving the pointer 5 in a state of making the tip portion of the pointer 5 be in contact with the screen 4.

In the PC interactive mode, the first image processing unit 14 performs the image processing on the received image data to generate an image signal. In the PC interactive mode, the image indicated by the received image data includes the second toolbar TB2 as illustrated in FIG. 3. In the PC interactive mode, the user causes the PC 2 to perform the processing corresponding to the clicked button by selectively clicking the buttons using the pointer 5.

The projection unit 15 projects and displays the image corresponding to the image signal generated by the first image processing unit 14 on the screen 4.

Figure 5:
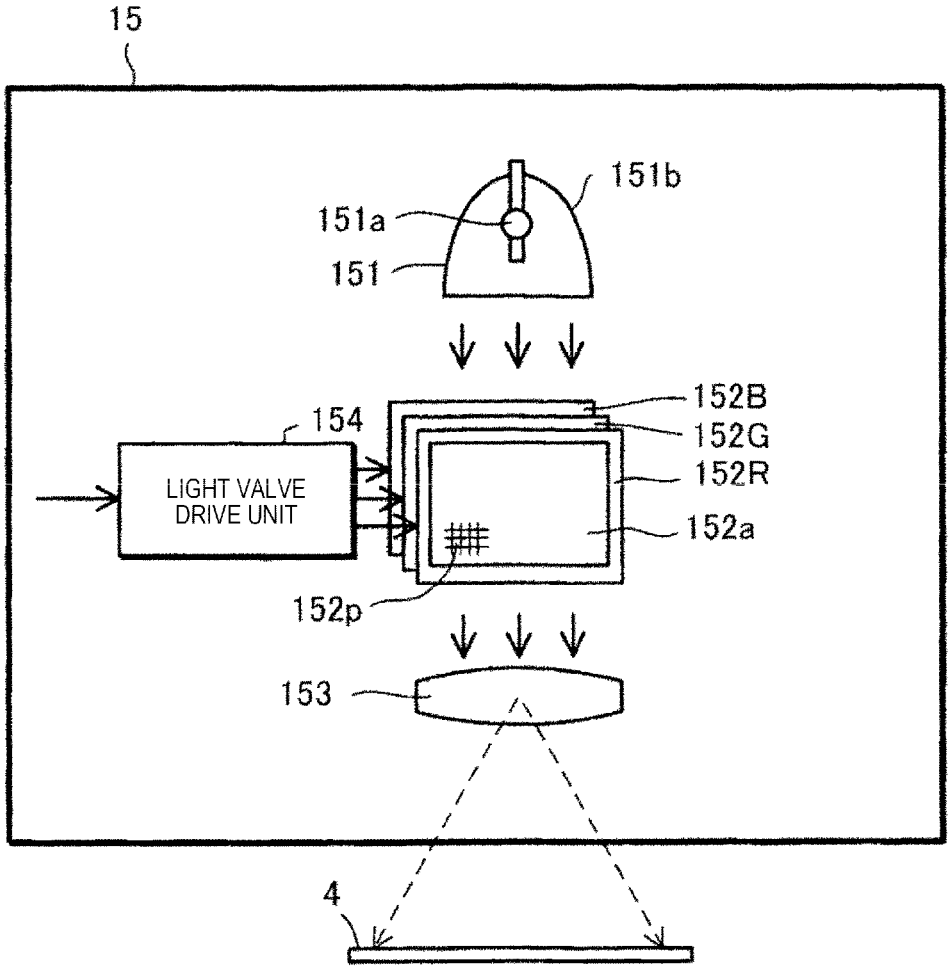
FIG. 5 is a diagram illustrating an example of a projection unit.

FIG. 5 is a diagram illustrating an example of the projection unit 15. The projection unit 15 includes a light source 151, three liquid crystal light valves 152R, 152G, and 152B as an example of a light modulation device, a projection lens 153 as an example of a projection optical system, a light valve drive unit 154, and the like. The projection unit 15 modulates the light emitted from the light source 151 with the liquid crystal light valves 152R, 152G, and 152B to generate a projection image (image light), and then, the projection image is magnified and projected through the projection lens 153.

The light source 151 includes a light source unit 151*a* configured with a xenon lamp, an extra-high pressure mercury lamp, a light emitting diode (LED), a laser light source or the like, and a reflector 151*b* for reducing variations in the direction of the light emitted by the light source unit 151*a*. A dispersion of luminance distribution of the light emitted from the light source 151 is reduced by an integrator optical system (not illustrated), and thereafter, the emitted light is separated into color light components of red, green and blue, which are the three primary colors of the light by a color separation light system (not illustrated). The red, green, and blue color light components are incident on the liquid crystal light valves 152R, 152G, 152B, respectively.

The liquid crystal light valves 152R, 152G, and 152B are configured with a liquid crystal panel or the like in which liquid crystal is sealed between a pair of transparent substrates. In each of the liquid crystal light valves 152R, 152G, and 152B, a rectangular pixel area 152*a* configured with a plurality of pixels 152*p* arrayed in a matrix shape, is formed. In the liquid crystal light valves 152R, 152G, and 152B, a drive voltage can be applied to the liquid crystal for each pixel 152*p*. When the light valve drive unit 154 applies the drive voltage corresponding to the image signal input from the first image processing unit 14 to each pixel 152*p*, each pixel 152*p* is set to have a light transmittance corresponding to the image signal. Therefore, the light emitted from the light source 151 is modulated by passing through the pixel area 152*a*, and a projection image corresponding to the image signal is formed for each color light.

The image of each color is synthesized for each pixel 152*p* by a color synthesizing optical system (not illustrated), and projection image light which is color image light is generated. The projection image light is magnified and projected onto the screen 4 by the projection lens 153.

Returning to FIG. 4, the image capturing unit 16 images the screen 4 and generates captured image data. The image capturing unit 16 includes an imaging element such as a charge coupled device (CCD) or a complementary metal oxide semiconductor (CMOS), for example, and images the screen 4 with infrared light. An imaging range of the image capturing unit 16 covers the extent to which the projection unit 15 projects the projection image onto the screen 4.

The first storage unit 17 is a computer readable recording medium. The first storage unit 17 is, for example, a flash memory. The first storage unit 17 stores a program that defines the operation of the projector 1. In addition, the first storage unit 17 stores the first toolbar data indicating the first toolbar TB1.

The first storage unit 17 further stores the calibration data. The calibration data is data for associating the coordinates on the captured image data with the coordinates on the liquid crystal light valves 152R, 152G, and 152B. The calibration data is generated by the projector 1 performing known calibration processing.

The first processing unit 18 is a computer such as a central processing unit (CPU). The first processing unit 18 may be configured with one or a plurality of processors. The first processing unit 18 realizes a coordinate detection unit 181, a first image data generation unit 182, and a first control unit 183 by reading and executing the program stored in the first storage unit 17.

The coordinate detection unit 181 detects coordinates indicating the position of the pointer 5.

First, the coordinate detection unit 181 first detects a first coordinate indicating the position of the pointer 5 based on the light emitting position of the pointer 5 represented in the captured image data. The first coordinate is a coordinate in the coordinate system of the captured image data. Subsequently, the coordinate detection unit 181 converts the first coordinate into the coordinate (hereinafter, referred to as a "second coordinate") in the coordinate system of the liquid crystal light valve 152R, 152G, and 152B using the calibration data. The second coordinate is an example of the position and the position information of the pointer 5.

The coordinate detection unit 181 outputs the second coordinate to the first image data generation unit 182 in the PJ interactive mode. The coordinate detection unit 181 outputs the second coordinate to the second communication unit 13 in the PC interactive mode. The second communication unit 13 transmits the second coordinate to the PC 2.

The first image data generation unit 182 is an example of a generation unit. The first image data generation unit 182 generates the PJ image data according to the position of the pointer 5. For example, the first image data generation unit 182 generates the PJ image data indicating an image corresponding to the trajectory of the second coordinate. The state in which the first image data generation unit 182 generates the image data according to the position of the pointer 5 is an example of a first state. The first image data generation unit 182 stores the image data generated according to the position of the pointer 5, that is, the PJ image data in the first storage unit 17.

The first control unit 183 is an example of a control unit. The first control unit 183 controls the projector 1. For example, when receiving the switching information via the first operation unit 11, the first control unit 183 switches the operation mode.

For example, when receiving first switching information to switch the operation mode from the PJ interactive mode to the PC interactive mode via the first operation unit 11, the first control unit 183 switches the operation mode from the PJ interactive mode to the PC interactive mode.

When the operation mode is switched from the PJ interactive mode to the PC interactive mode, the first control unit 183 switches the output destination of the second coordinate output from the coordinate detection unit 181, to the second communication unit 13 from the first image data generation unit 182.

When the output of the second coordinate to the first image data generation unit 182 is stopped, the first state in which the first image data generation unit 182 generates the image data according to the position of the pointer 5 ends. Then, when the transmission of the second coordinate to the PC 2 starts, the second state in which the PC 2 generates the image data according to the position of the pointer 5 starts.

When the output destination of the second coordinate is switched from the first image data generation unit 182 to the second communication unit 13, the first control unit 183 generates the transmission image information using the PJ image data stored in the first storage unit 17.

The first control unit 183 generates the image information indicating a superimposed image which is obtained by superimposing the image indicated by the PJ image data stored in the first storage unit 17 on the image indicated by the received image data received from the PC 2 when the first switching information is received, as the transmission image information. The image indicated by the transmission image information may include the image indicated by the PJ image data stored in the first storage unit 17.

Subsequently, the first control unit 183 causes the second communication unit 13 to perform a transmission operation (hereinafter also simply referred to as "transmission operation") transmitting transmission image information to the PC 2.

When receiving second switching information to switch the operation mode from the PC interactive mode to the PJ interactive mode via the first operation unit 11, the first control unit 183 switches the operation mode from the PC interactive mode to the PJ interactive mode.

When the operation mode is switched from the PC interactive mode to the PJ interactive mode, the first control unit 183 switches the output destination of the second coordinate output from the coordinate detection unit 181, from the second communication unit 13 to the first image data generation unit 182.

When the output of the second coordinate to the second communication unit 13 is stopped, the second state in which the PC 2 generates the image data according to the position of the pointer 5 ends. On the other hand, when the output of the second coordinate to the first image data generation unit 182 starts, the first state in which the first image data generation unit 182 generates the image data according to the position of the pointer 5 starts.

Next, the PC2 will be described.

The PC 2 includes a second operation unit 21, a third communication unit 22, a fourth communication unit 23, a second image processing unit 24, a display unit 25, a second storage unit 26, a second processing unit 27, and a second bus 28. The second operation unit 21, the third communication unit 22, the fourth communication unit 23, the second image processing unit 24, the display unit 25, the second storage unit 26, and the second processing unit 27 can communicate with each other via the second bus 28.

The second operation unit 21 is, for example, various operation buttons, operation keys or a touch panel. The second operation unit 21 receives an input operation from the user.

The third communication unit 22 communicates with the projector 1 via the HDMI cable 31. The third communication unit 22 sends the received image data to the projector 1.

The fourth communication unit 23 transmits and receives various data items to and from the projector 1 via the USB cable 32. If the operation mode is switched from the PJ interactive mode to the PC interactive mode, the fourth communication unit 23 receives the transmission image information from the projector 1. If the operation mode is the PC interactive mode, the fourth communication unit 23 receives the second coordinate from the projector 1.

The second image processing unit 24 performs the image processing on the image data to generate an image signal.

In the PJ interactive mode, the second image processing unit 24 performs the image processing on the image data read from the second storage unit 26 to generate an image signal.

In the PC interactive mode, the second image processing unit 24 generates an image signal indicating a superimposed image which is obtained by superimposing the image indicated by the PC image data and the second toolbar TB2 on the image indicated by the image data read from the second storage unit 26 using the image data read from the second storage unit 26, the PC image data generated by the second image data generation unit 271 (to be described later), and the second toolbar data indicating the second toolbar TB2. As will be described later, the PC image data generated by the second image data generation unit 271 is stored in the second storage unit 26. Therefore, the second image processing unit 24 reads the PC image data generated by the second image data generation unit 271 from the second storage unit 26.

The second toolbar TB2 illustrated in FIG. 3 includes a color selection button CCB for selecting the color of the line to be drawn in addition to the buttons of the first toolbar TB1 illustrated in FIG. 1.

The display unit 25 is, for example, a liquid crystal display (LCD). The display unit 25 displays an image corresponding to the image signal generated by the second image processing unit 24. The display unit 25 is not limited to the LCD but can be changed as appropriate. For example, the display unit 25 may be an organic electroluminescence (EL) display, an electrophoretic display (EPD), or a touch panel display.

The second storage unit 26 is a computer readable recording medium. The second storage unit 26 is, for example, a flash memory. The second storage unit 26 stores programs defining the operation of the PC 2 and various information items. The various information items include the image data and the second toolbar data.

The second processing unit 27 is a computer such as a CPU. The second processing unit 27 may be configured with one or a plurality of processors. The second processing unit 27 realizes the second image data generation unit 271 and the second control unit 272 by reading and executing the program stored in the second storage unit 26.

The second image data generation unit 271 generates the PC image data according to the position of the pointer 5. For example, the second image data generation unit 271 generates the PC image data indicating the image corresponding to the trajectory of the second coordinate received from the projector 1.

The second image data generation unit 271 stores the image data generated according to the position of the pointer 5, that is, the PC image data, in the second storage unit 26.

The second control unit 272 controls the PC 2.

For example, if the fourth communication unit 23 does not receive the second coordinate which is the position information, that is, if the operation mode is the PJ interactive mode, the second control unit 272 reads the image data from the second storage unit 26. The second control unit 272 causes the third communication unit 22 to perform the operation of transmitting the read image data to the projector 1.

On the other hand, if the fourth communication unit 23 receives the second coordinate, that is, if the operation mode is the PC interactive mode, the second control unit 272 causes the third communication unit 22 to execute the operation of transmitting the image signal generated by the second image processing unit 24 to the projector 1 as the received image data.

Next, the operation will be described.

Figure 6:
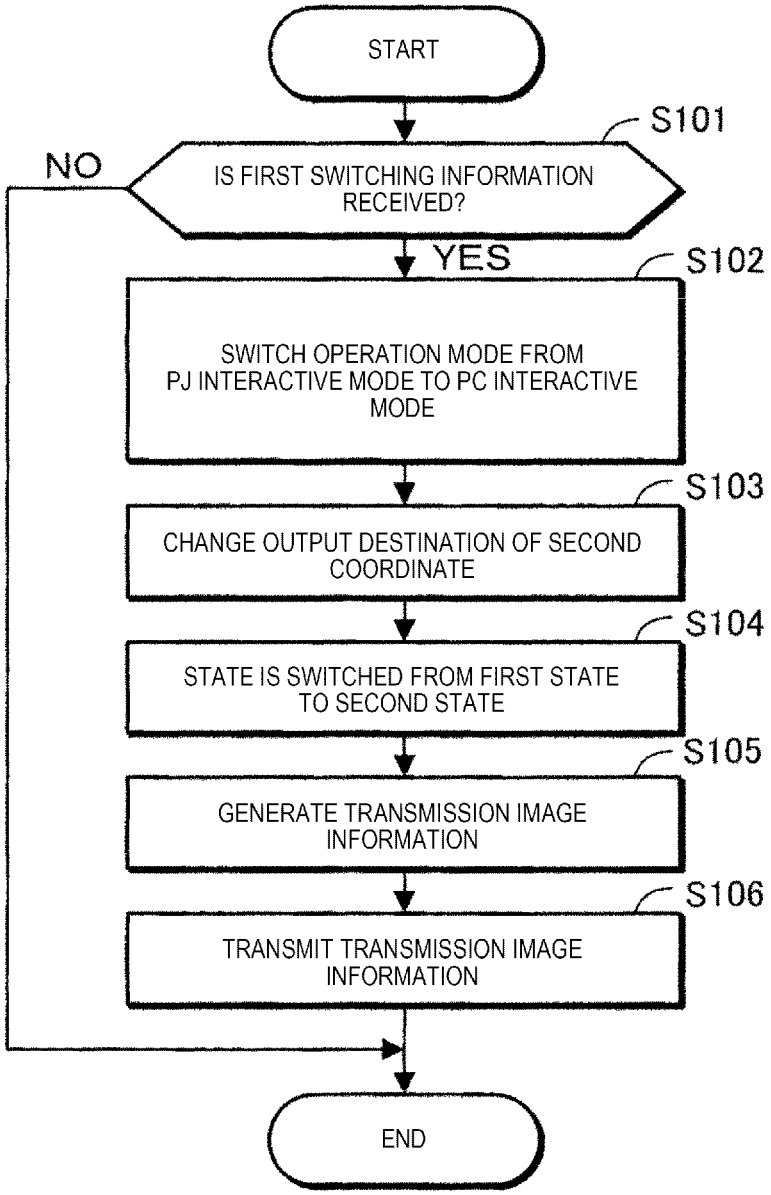
FIG. 6 is a flowchart for explaining an operation of switching the operation mode from a PJ interactive mode to a PC interactive mode.

FIG. 6 is a flowchart for explaining the operation of switching the operation mode from the PJ interactive mode to the PC interactive mode. The display system 100 repeats the operation illustrated in FIG. 6 when the operation mode is the PJ interactive mode.

It is assumed that the PJ image data indicating the image G illustrated in FIG. 1 is generated when the operation mode is the PJ interactive mode. In this situation, upon receiving the first switching information (YES in STEP S101), the first operation unit 11 outputs the first switching information to the first control unit 183. Upon receiving the first switching information, the first control unit 183 switches the operation mode from the PJ interactive mode to the PC interactive mode (STEP S102).

Subsequently, the first control unit 183 controls the coordinate detection unit 181 to switch the output destination of the second coordinate from the coordinate detection unit 181, from the first image data generation unit 182 to the second communication unit 13 (STEP S103). The second communication unit 13 transmits the second coordinate received from the coordinate detection unit 181 to the PC 2.

When the output of the second coordinate to the first image data generation unit 182 is stopped, the first state in which the first image data generation unit 182 generates the image data according to the position of the pointer 5 ends. When the output of the second coordinate to the PC 2 starts, the second state in which the PC 2 generates image data according to the position of the pointer 5 starts (STEP S104).

Subsequently, the first control unit 183 generates the transmission image information (STEP S105). For example, the first control unit 183 generates the image information indicating the superimposed image which is obtained by superimposing the image indicated by the PJ image data stored in the first storage unit 17 to the image indicated by the image data received from the PC 2 when the first switching information is received, as the transmission image information. The transmission image information is, for example, bitmap format image data such as bitmap data.

Subsequently, the first control unit 183 causes the second communication unit 13 to perform the transmission operation of transmitting the transmission image information to the PC 2 (STEP S106), and then, the operation illustrated in FIG. 6 ends. When the first operation unit 11 does not receive the first switching information, the operation illustrated in FIG. 6 ends.

In the PC 2, the second image data generation unit 271 receives the transmission image information via the fourth communication unit 23. The second image data generation unit 271 uses the transmission image information as the PC image data.

According to a method of controlling the projector 1, the display system 100 and the display device in the present embodiment, when the state is switched from the first state to the second state, the first control unit 183 causes the second communication unit 13 to perform the transmission operation of transmitting the transmission image information to the PC 2.

Therefore, even if a main entity that generates the image data according to the position of the pointer 5 is switched from the projector 1 to the PC 2, the PC 2 can take over the image corresponding to the image data generated by the projector 1. Therefore, it is possible to reduce the possibility that the drawing result in the projector 1 is wasted, and it is possible to reduce the possibility that the user must reproduce the drawing result in the projector 1 again using the PC 2.

When receiving the first switching information, the first control unit 183 causes the second communication unit 13 to perform the transmission operation after stopping the first state and starting the second state.

Therefore, it is possible to use the first switching information as an instruction to take over the image. Accordingly, even if there is no instruction to take over the image, it is possible to automatically take over the image.

Since the transmission image information is bitmap format image data such as bitmap data, even if the transmission image information indicates a complicated image, the PC 2 can display the images according to the transmission image information with high reproducibility.

MODIFICATION EXAMPLE

The present invention is not limited to the embodiment described above, and various modifications as described below can be made. Furthermore, any of one or a plurality of modifications selected from the aspects described below can be appropriately combined.

Modification Example 1

The format of the transmission image information is not limited to the bitmap format image data such as the bitmap data, and can be appropriately changed. As an example, the transmission image information may include vector data in which the PJ image data generated by the first image data generation unit 182 is represented on an object unit basis.

Figures 7, 8:
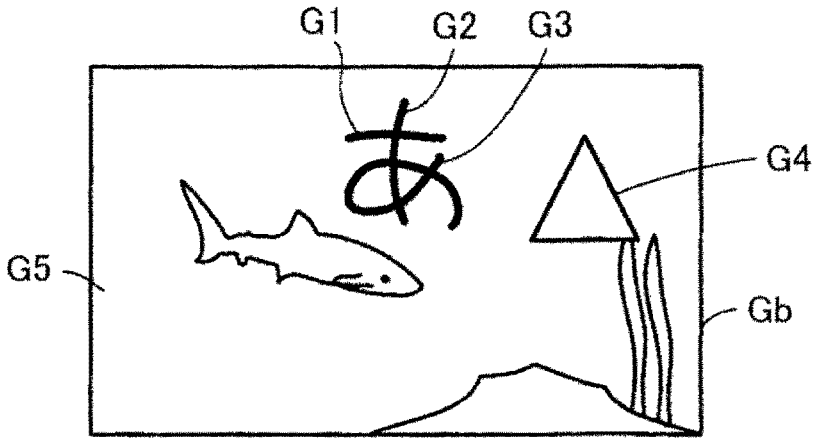
FIG. 7 is a diagram illustrating a first image.
FIG. 8 is a diagram illustrating first information.

For example, it is assumed that the image indicated by the transmission image information is the first image Gb illustrated in FIG. 7. The first image Gb includes a first object G1, a second object G2, a third object G3, a fourth object G4, and a fifth object G5. Each of the first object G1, the second object G2, and the third object G3 is a free line. The first object G1, the second object G2, and the third object G3 belong to the same group. The fourth object G4 is a triangular figure. The fifth object G5 is a bitmap format image. Each of the first object G1, the second object G2, the third object G3, and the fourth object G4 is an image corresponding to the PJ image data. The fifth object G5 is an image corresponding to the received image data received from the PC 2.

In this case, the first control unit 183 transmits first information D1 illustrated in FIG. 8 as the transmission image information. The first information D1 includes first vector data V1 representing the first object G1, second vector data V2 representing the second object G2, third vector data V3 representing the third object G3, fourth vector data V4 representing the fourth object G4, and first image data B1 in a bitmap format such as bitmap data representing the fifth object G5.

Figures 9, 10:
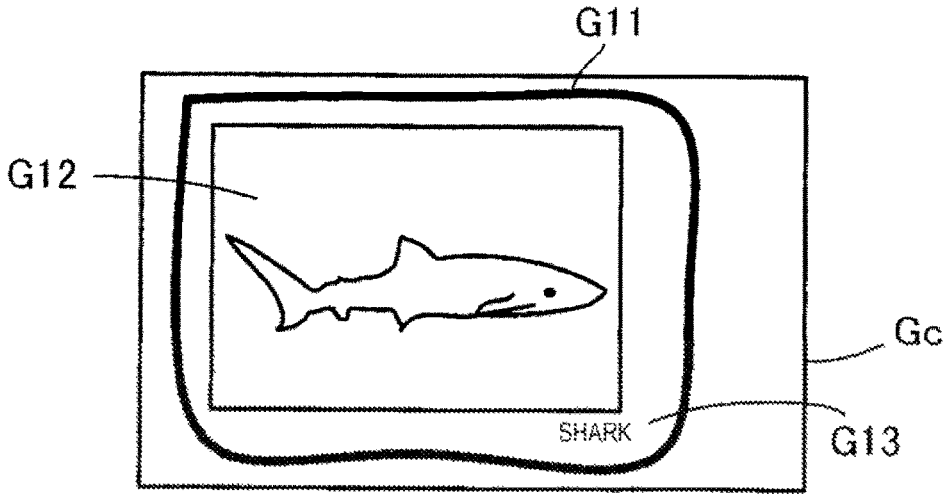
FIG. 9 is a diagram illustrating a second image.
FIG. 10 is a diagram illustrating second information.

In addition, it is assumed that the image indicated by the transmission image information is a second image Gc illustrated in FIG. 9.

The second image Gc includes a sixth object G11, a seventh object G12, and an eighth object G13. The sixth object G11 is a free line. The seventh object G12 is a bitmap format image. The eighth object G13 is a text. Each of the sixth object G11 and the eighth object G13 is an image corresponding to the PJ image data. The seventh object G12 is an image corresponding to the received image data received from the PC 2.

In this case, the first control unit 183 transmits second information D2 illustrated in FIG. 10 as the transmission image information. The second information D2 includes fifth vector data V11 representing the sixth object G11, second image data B11 in a bit map format such as bitmap data representing the seventh object G12, and sixth vector data V12 representing the eighth object G13.

If the transmission image information includes the vector data representing the PJ image data on an object unit basis, it is possible to edit the image indicated by the PJ image data taken over by the PC 2 on an object unit basis.

Modification Example 2

The second image data generation unit 271 may be activated when the second operation unit 21 of the PC 2 receives a setting operation of setting the operation mode to the PC interactive mode. In this case, in response to the activation of the second image data generation unit 271, it is desirable that the fourth communication unit 23 transmits a request notification to the projector 1 to request the second coordinate. The request notification is an example of a notification notifying that the second state is requested.

If the request notification is received via the second communication unit 13 when the operation mode is PJ interactive mode, the first control unit 183 switches the output destination of the second coordinate output from the coordinate detection unit 181, from the first image data generation unit 182 to the second communication unit 13. Subsequently, the first control unit 183 generates the transmission image information, and causes the second communication unit 13 to perform the transmission operation of transmitting the generated transmission image information to the PC 2.

In this case, the request notification can be used as an instruction to take over the image. Therefore, even if there is no instruction to take over the image, the image can be automatically taken over.

Modification Example 3

When the operation mode is switched from the PC interactive mode to the PJ interactive mode, the first control unit 183 may cause the second communication unit 13 to perform an operation of transmitting a PC image data request for requesting the PC image data to the PC 2.

When the PC image data request is received via the fourth communication unit 23, the second control unit 272 of the PC 2 generates image information (hereinafter, referred to as "providing image information") according to the image including the image indicated by the PC image data. Subsequently, the second control unit 272 causes the fourth communication unit 23 to perform an operation of transmitting the providing image information to the projector 1.

The first image data generation unit 182 of the projector 1 receives the providing image information via the second communication unit 13. The first image data generation unit 182 uses the providing image information as the PJ image data.

According to the modification example 3, the second communication unit 13 receives the providing image information when the operation mode is switched from the PC interactive mode to the PJ interactive mode.

Therefore, even if the main entity that generates the image data according to the position of the pointer 5 is switched from the PC 2 to the projector 1, the projector 1 can take over the image according to the image data generated by the PC 2. Therefore, it is possible to reduce the possibility that the drawing result in the PC 2 is wasted, and it is possible to reduce the possibility that the user must reproduce the drawing result in the PC2 again using the projector 1.

Modification Example 4

The pointer 5 is not limited to the electronic pen that emits infrared light, but the pointer can be changed as appropriate. For example, the pointer 5 may be a user's finger or a pen that does not emit the infrared light. For example, if the user's finger or the pen that does not emit the infrared light is used as the pointer 5, the projector 1 emits flat-shaped infrared detection light along the screen 4 and specifies the position of the pointer 5 by detecting the reflection position of the detection light at the pointer 5 based on the captured image data.

Modification Example 5

The cable for the communication for the received image data is not limited to the HDMI cable 31, but, can be changed as appropriate. The communication for the received image data from the PC 2 to the projector 1 may be wirelessly performed.

The cable for the communication for the second coordinate indicating the position of the pointer 5 and the transmission image information is not limited to the USB cable 32, but can be changed as appropriate. The communication for at least one of the second coordinate and the transmission image information from the projector 1 to the PC 2 may be wirelessly performed.

The communication for the received image data, the second coordinate, and the transmission image information between the projector 1 and the PC 2 may be performed via one line of communication cable.

Modification Example 6

A liquid crystal light valve is used as an example of a light modulation device, but the light modulation device is not limited to a liquid crystal light valve, but can be changed as appropriate. For example, the light modulation device may have a configuration using three reflective liquid crystal panels. Furthermore, the light modulation device may have a configuration using one liquid crystal panel, a configuration using three digital mirror devices (DMD), a configuration using one digital mirror device, or the like. If only one liquid crystal panel or the DMD is used as the light modulation device, members corresponding to the color separation optical system and the color synthesis optical system are unnecessary. In addition to the liquid crystal panel and the DMD, any configuration capable of modulating the light emitted by the light source 151 can be adopted as the light modulation device.

Modification Example 7

The projector was used as the display device, but the display device is not limited to the projector, but can be changed as appropriate. For example, the display device may be a direct view type display. The direct view type display is, for example, a liquid crystal display, an organic electro luminescence (EL) display, a plasma display or a cathode ray tube (CRT) display. In this case, the direct view type display may have a display surface with a touch panel, for example. If the direct view type display has the display surface with the touch panel, the coordinate detection unit 181 may detect the position of the pointer 5 using the position touched by the pointer 5 on the touch panel.

Modification Example 8

All or a part of the elements realized by reading and executing the program by at least one of the first processing unit 18 and the second processing unit 27 may be realized by hardware of an electronic circuit such as a field programmable gate array (FPGA) or an application specific IC (ASIC), or may be realized by a cooperation between the software and the hardware.

Modification Example 9

The information processing device is not limited to PC, but can be changed as appropriate.

What is claimed is:

1. A display device comprising:

a processor programmed to generate first image data according to a position of a pointer; and a transmitter/receiver that communicates with an information processing device that generates second image data according to the position of the pointer, wherein the processor is further programmed to cause the transmitter/receiver to perform a transmission operation of transmitting first image information corresponding to an image indicated by the first image data generated by the processor in a first state in which the processor generates the first image data according to the position of the pointer, to the information processing device, when a state is switched from the first state to a second state in which the information processing device generates the second image data according to the position of the pointer, wherein the first image information is transmitted to the information processing device only once and only at the time at which the state is switched from the first state to the second state, and only position information of the position of the pointer, without the first image information, is transmitted to the information processing device while the state remains in the second state.

2. The display device according to claim 1, wherein the processor causes the transmitter/receiver to perform the transmission operation after ending the first state and starting the second state, when a switching instruction to switch the first state to the second state is received.

3. The display device according to claim 1, wherein the processor causes the transmitter/receiver to perform the transmission operation after ending the first state and starting the second state, when a notification of requesting the second state is received.

4. The display device according to claim 1, wherein the first image information is bitmap format image data.

5. The display device according to claim 1, wherein the first image information includes vector data in which the first image data generated by the processor is represented on an object unit basis.

6. The display device according to claim 1, wherein the transmitter/receiver receives second image information corresponding to the image indicated by the second image data generated by the information processing device in the second state, when the state is switched from the second state to the first state.

7. A display system comprising:

the display device according to claim 1; and the information processing device.

8. A display system comprising:

the display device according to claim 2; and the information processing device.

9. A display system comprising:

the display device according to claim 3; and the information processing device.

10. A display system comprising:

the display device according to claim 4; and the information processing device.

11. A display system comprising:

the display device according to claim 5; and the information processing device.

12. A display system comprising:

the display device according to claim 6; and the information processing device.

13. A method of controlling a display device, comprising:

generating first image data according to a position of a pointer; and transmitting first image information corresponding to an image indicated by the first image data generated in a first state in which the display device generates the first image data according to the position of the pointer, to an information processing device, when a state is switched from the first state to a second state in which the information processing device generates second image data according to the position of the pointer, wherein the first image information is transmitted to the information processing device only once and only at the time at which the state is switched from the first state to the second state, and only position information of the position of the pointer, without the first image information, is transmitted to the information processing device while the state remains in the second state.

14. A display device having operation mode in which a position of a pointer is used comprising:

a communication interface that communicates with an information processing device; and a processor configured to switch the operation mode and generate first image data according to the position of the pointer in a first operation mode included in the operation mode, wherein when the processor switches the operation mode from the first operation mode to a second operation mode included in the operation mode, the communication interface transmits a superimposed image to the information processing device, the superimposed image is obtained by superimposing an image of the first image data according to the position of the pointer on an image received from the information processing device, and the superimposed image is transmitted to the information processing device only once and only at the time at which the operation mode is switched from the first operation mode to the second operation mode, and only position information of the position of the pointer, without the superimposed image, is transmitted to the information processing device while the operation mode remains in the second operation mode.

15. The display device according to claim 14, wherein the processor does not generate image data according to the position of the pointer in the second operation mode.

* * * * *